US007901489B2

(12) United States Patent
Jin et al.

(10) Patent No.: US 7,901,489 B2
(45) Date of Patent: Mar. 8, 2011

(54) ELECTROSTATIC PRECIPITATOR WITH HIGH EFFICIENCY

(75) Inventors: Lieshui Jin, ZhuJi (CN); Ye Yuan, BenXi (CN)

(73) Assignee: Environmental Research Institute, Zhuji, Zhenjiang Province (CN)

( * ) Notice: Subject to any disclaimer, the term of this patent is extended or adjusted under 35 U.S.C. 154(b) by 468 days.

(21) Appl. No.: 11/990,180

(22) PCT Filed: Aug. 9, 2006

(86) PCT No.: PCT/CN2006/002010
§ 371 (c)(1),
(2), (4) Date: May 8, 2008

(87) PCT Pub. No.: WO2007/016872
PCT Pub. Date: Feb. 15, 2007

(65) Prior Publication Data

US 2010/0154642 A1 Jun. 24, 2010

(30) Foreign Application Priority Data

Aug. 10, 2005 (CN) ..... 2005 1 0017874

(51) Int. Cl.
*B03C 3/76* (2006.01)

(52) U.S. Cl. ..... 96/30; 96/31; 96/32; 96/62; 96/73; 96/87

(58) Field of Classification Search ..... 96/30–32, 96/60, 62, 64, 73, 86, 87, 97; 95/76, 78
See application file for complete search history.

(56) References Cited

U.S. PATENT DOCUMENTS

| | | | | | |
|---|---|---|---|---|---|
| 387,286 | A | * | 8/1888 | Fewson | 422/186.07 |
| 1,335,758 | A | * | 4/1920 | Schmidt | 209/129 |
| 1,345,790 | A | * | 7/1920 | Lodge | 96/62 |
| 3,733,785 | A | * | 5/1973 | Gallaer | 96/64 |
| 3,803,808 | A | * | 4/1974 | Shibuya et al. | 96/54 |
| 3,988,127 | A | * | 10/1976 | Schumann | 95/76 |
| 3,994,704 | A | * | 11/1976 | Shibuya et al. | 96/60 |
| 4,264,343 | A | * | 4/1981 | Natarajan et al. | 96/48 |
| 4,844,718 | A | * | 7/1989 | Schmidt et al. | 95/26 |

(Continued)

FOREIGN PATENT DOCUMENTS

CN 2198978 Y 5/1995

(Continued)

*Primary Examiner* — Richard L Chiesa
(74) *Attorney, Agent, or Firm* — McDermott Will & Emery LLP

(57) ABSTRACT

This invention relates to an electrostatic precipitator suitable for removing industrial dust particles. This electrostatic precipitator with high efficiency includes a casing, in which the corona discharge electrode lines and the dust-collecting electrode plates, which form a plurality of sedimentation passages, are arranged in parallel and alternately. The vibration apparatuses for cleaning dust are placed respectively on the corona discharge electrode lines and the dust-collecting electrode plates. The wind shields are arranged alternately at both ends of each two adjacent sedimentation passages to form a plurality of air intake sedimentation passages and air exhaust sedimentation passages which are arranged alternately. The passages, where the wind shields are located on the side of air outlet are the air intake sedimentation passages and the air exhaust sedimentation passages with the wind shields located on the side of air inlet. There is a plurality of air vents distributed on the dust-collecting electrode plates. A valve is mounted on the side of air outlet of each air exhaust sedimentation passage for closing the air outlet.

6 Claims, 8 Drawing Sheets

U.S. PATENT DOCUMENTS

| | | | | |
|---|---|---|---|---|
| 5,037,456 | A | 8/1991 | Yu | |
| 5,938,818 | A * | 8/1999 | Miller | 95/63 |
| 6,872,238 | B1 * | 3/2005 | Truce | 95/29 |
| 2007/0095207 | A1 * | 5/2007 | Tolvanen | 95/76 |
| 2009/0071328 | A1 * | 3/2009 | Dunn | 95/62 |

FOREIGN PATENT DOCUMENTS

| | | | | |
|---|---|---|---|---|
| CN | 2481982 | Y | 3/2002 | |
| JP | 53-2767 | A * | 1/1978 | 96/60 |
| JP | 4-27454 | | 1/1992 | |
| WO | WO 88/03057 | | 5/1988 | |

* cited by examiner

ELECTROSTATIC PRECIPITATOR WITH HIGH EFFICIENCY

RELATED APPLICATIONS

This application is the U.S. National Phase under 35 U.S.C. §371 of International Application No. PCT/CN2006/002010, filed on Aug. 9, 2006, which in turn claims the benefit of Chinese Application No. 200510017874.9, filed on Aug. 10, 2005, the disclosures of which Applications are incorporated by reference herein.

FIELD OF THE INVENTION

The present invention relates to an electrostatic precipitator suitable for removing industrial dust particles and more particularly, to an electrostatic precipitator with high efficiency suitable for removing sub-micron-sized dust particles.

BACKGROUND OF THE INVENTION

For well-known electrostatic precipitators at present, corona discharge electrode lines and dust-collecting electrode plates which form a plurality of sedimentation passages are mounted in a casing. The negative DC high voltage electricity is applied to the corona discharge electrode lines to discharge negative electric ions which are used for charging dust particles contained in the dust-laden airflow electrically. While, the positive DC high voltage electricity is applied to the dust-collecting electrode plates to collect the negative dust particles charged electrically. Then, the vibration apparatus vibrates the dust particles collected from the dust-collecting electrode plates down to the hoppers at the lower part of the precipitators and accordingly the removal of dust particles in the airflow can be achieved.

However, precipitators of this kind have extremely poor efficiency on removing sub-micron-sized dust particles contained in the dust-laden airflow. Furthermore, when the dust is cleaned by vibration, a part of the dust is always discharged out with airflow due to the flying dust for the second time by vibration. Accordingly, the efficiency of the precipitators becomes instable and the concentration of dust particles in the exhaust air always stays high.

According to related national standards, the discharge concentration of the industrial dust is controlled at 50 mg/m$^3$ according to the most advanced dust removing technologies at present. However, this standard has no limitation on the discharge control of sub-micron-sized dust, which is really harmful to the health of human beings. At present, in China, more than 8 million tons of the sub-micron-sized aerosol dust is discharged into the air each year. Because it is very difficult for sub-micron-sized aerosol dust particles to settle, after the accumulation, they make air pollution more and more severe. According to the current conditions of the air environmental protection in China, in order to remove harmful substances in the air effectively and to get blue sky back fundamentally, the concentration of sub-micron-sized aerosol in the air discharged from all mines, factories and enterprises needs to be controlled below 1 mg/m$^3$. However, dust removers in the present market can never remove sub-micron-sized aerosol particles in industrial dust.

SUMMARY OF THE INVENTION

Aiming at the above-mentioned disadvantages in the prior art, the technical problem to be solved in the present invention is to provide an electrostatic precipitator with high efficiency which can remove sub-micron-sized dust particles effectively.

The technical solution for solving the problems proposed by the present invention is as follows: this electrostatic precipitator with high efficiency includes a casing. At both ends of the casing, an inlet chamber and an outlet chamber are arranged respectively. A dust hopper is arranged at the lower part of the casing. In the casing, corona discharge electrode lines and dust-collecting electrode plates, which form a plurality of sedimentation passages, are arranged in parallel and alternately. Vibration apparatuses for cleaning dust are placed respectively on the corona discharge electrode lines and the dust-collecting electrode plates. The corona discharge electrode lines are connected to the negative terminal of high voltage DC output, while the dust-collecting electrode plates are connected to the positive terminal of high voltage DC output and to the earth. Wind shields are arranged alternately at both ends of each of the two adjacent sedimentation passages to form a plurality of air intake sedimentation passages and air exhaust sedimentation passages which are arranged alternately. The passages, where the wind shields are located on the side of an air outlet are the air intake sedimentation passages and the air exhaust sedimentation passages with the wind shields are located on the side of an air inlet. A plurality of air vents are distributed on the dust-collecting electrode plates.

Preferably, said air vents may be holes distributed on the dust-collecting electrode plates uniformly.

Said air vents on the dust-collecting electrode plates may be long rectangular holes with a width of 20-50 mm and a length of 100-800 mm. They also may be small elliptical holes with a long axis diameter of 20-50 mm and a short axis diameter of 20-30 mm.

For the electrostatic precipitators in the prior art, it is difficult for the sub-micron-sized dust particles to be absorbed by the dust-collecting electrode plates because the smaller size of the sub-micron-sized dust particles, the smaller absorbability they have, and they always flow into the precipitators and then flow out without any change. In the electrostatic precipitator of the present invention, the wind shields are arranged alternately at both ends of each two adjacent sedimentation passages to form a plurality of air intake sedimentation passages and air exhaust sedimentation passages which are arranged alternately. Therefore, the smaller dust particles moving with the air flow in the air intake sedimentation passages are forced to flow through the air vents on the dust-collecting electrode plates into the adjacent air exhaust sedimentation passages. When the sub-micron-sized dust particles closely go through the air vents on the dust-collecting electrode plates, the moving direction of these particles is changed from a lateral movement to a longitudinal movement, i.e. the particles move closely toward the dust-collecting electrode plates. According to the coulomb theory, the closer the dust particles are to the dust-collecting electrode plates, the more absorbability of the dust-collecting electrode plates to the dust particles. Therefore, the micron-sized dust particles can be captured easily and closely at the air vents of the dust-collecting electrode plates.

If a plurality of arrays of longitudinal and parallel sedimentation passages is called as an electric field for dust removal, in order to improve the efficiency of dust removal, a plurality of electric fields for dust removal are usually arranged in the electrostatic precipitators. While, because of the high efficiency of dust removal, the present invention only arranges one electric field for dust removal to achieve the effect of that of the plurality of electric fields in the prior art.

In addition, the intake of the inlet chamber in the prior art is usually 0.7-1.2 m/s. After the intake is increased, not only the efficiency of dust removal of existing precipitators cannot be improved, but also it can be negatively influenced due to excessive intake. However, for the precipitator of the present invention, after the intake is increased, the speed of dust particles for flowing through the air vents is not increased too much on account of the principle of distribution, so the air speed can be increased effectively and the working efficiency of the precipitator is improved accordingly.

Preferably, a valve is mounted on the side of the air outlet of each air exhaust sedimentation passage for closing the air outlet. An automatic control system is available to control shutting and opening the valve. Because both the corona discharge electrode line and the dust-collecting electrode plate are provided with the vibration apparatuses for cleaning dust, and the shutting and opening of the valve act synchronously together with the vibration apparatuses, the valve may be closed when the dust absorbed by both the corona discharge electrode line and the dust-collecting electrode plate reaches certain amount. Then, the vibration apparatuses in this sedimentation passage are started under the conditions of no air, and the dust absorbed is vibrated and falls down to the dust hopper located at the lower part of the casing. Because this sedimentation passage is closed by a valve, the flying dust for the second time due to vibration will not be discharged out with the air flow. After all dust in this sedimentation passage falls down to the dust hopper, in turn, the valve for the next sedimentation passage is closed and such operation is repeated.

In order to improve the efficiency of dust removal, in the present invention, a plurality of arrays of longitudinal and parallel sedimentation passages form an electric field for dust removal, and in the casing, two or more than two electric fields for dust removal may be arranged along the direction of the transverse section.

When two or more than two electric fields for dust removal are arranged in the casing, a valve is mounted on the side of the air outlet of the air exhaust sedimentation passage of the last electric field for closing the air outlet. An automatic control system is available to control the shutting and opening of the valve and the vibration of the vibration apparatuses for cleaning dust in that sedimentation passage to act synchronously.

The beneficial effects of the present invention are as follows:

1. To collect sub-micron-sized dust particles in high efficiency and to improve the ability of capturing the dust particles with high specific electric resistance;

2. To prevent the flying dust for the second time from being discharged with air flow and to decrease the concentration of the dust in the exhaust air in a large scale, and accordingly to keep the electrostatic precipitator having a high and stable efficiency;

3. To increase the air speed of the air intake and accordingly to improve the working efficiency for dust removal;

4. To reduce more than ⅓ of the volume of the present invention comparing to the electrostatic precipitators with the same specifications in the current market and accordingly to greatly reduce the cost of the electrostatic precipitator.

The present invention applies to all kinds of electrostatic precipitators and bag-house dust collectors and can be widely used in metallurgy, cement, power plant and chemical industries and etc.

Wherein: 1—Corona discharge electrode lines 2—Dust-collecting electrode plates 3—Wind shield 4—Air intake sedimentation passage 5—Air exhaust sedimentation passage 6—Casing 7—Inlet chamber 8—Outlet chamber 9—Air flow distribution board 10—Valve 11—Dust hopper 12—Vibration apparatus for cleaning dust 13—Air vent 14—Discharge electrode tip 15—Corona discharge electrode plate

DETAILED DESCRIPTION OF THE PREFERRED EMBODIMENT

Figure 1:
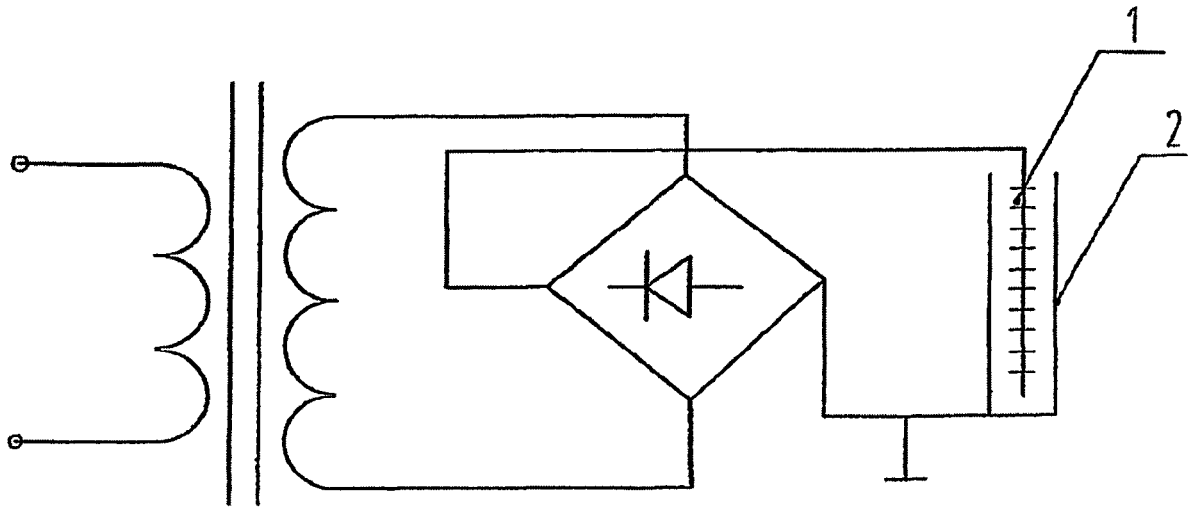
FIG. 1 is a circuit diagram of the electrostatic precipitator of the present invention.

As shown in FIG. 1, the corona discharge electrode lines 1 are connected to the negative terminal of the high voltage DC output, while the dust-collecting electrode plates 2 are connected to the positive terminal of the high voltage DC output and to earth.

The present invention will be further explained in detail as below with reference to the preferred embodiments and accompanying drawings. The flowing embodiments are unrestrictive embodiments of the present invention.

Embodiment 1

Figure 2:
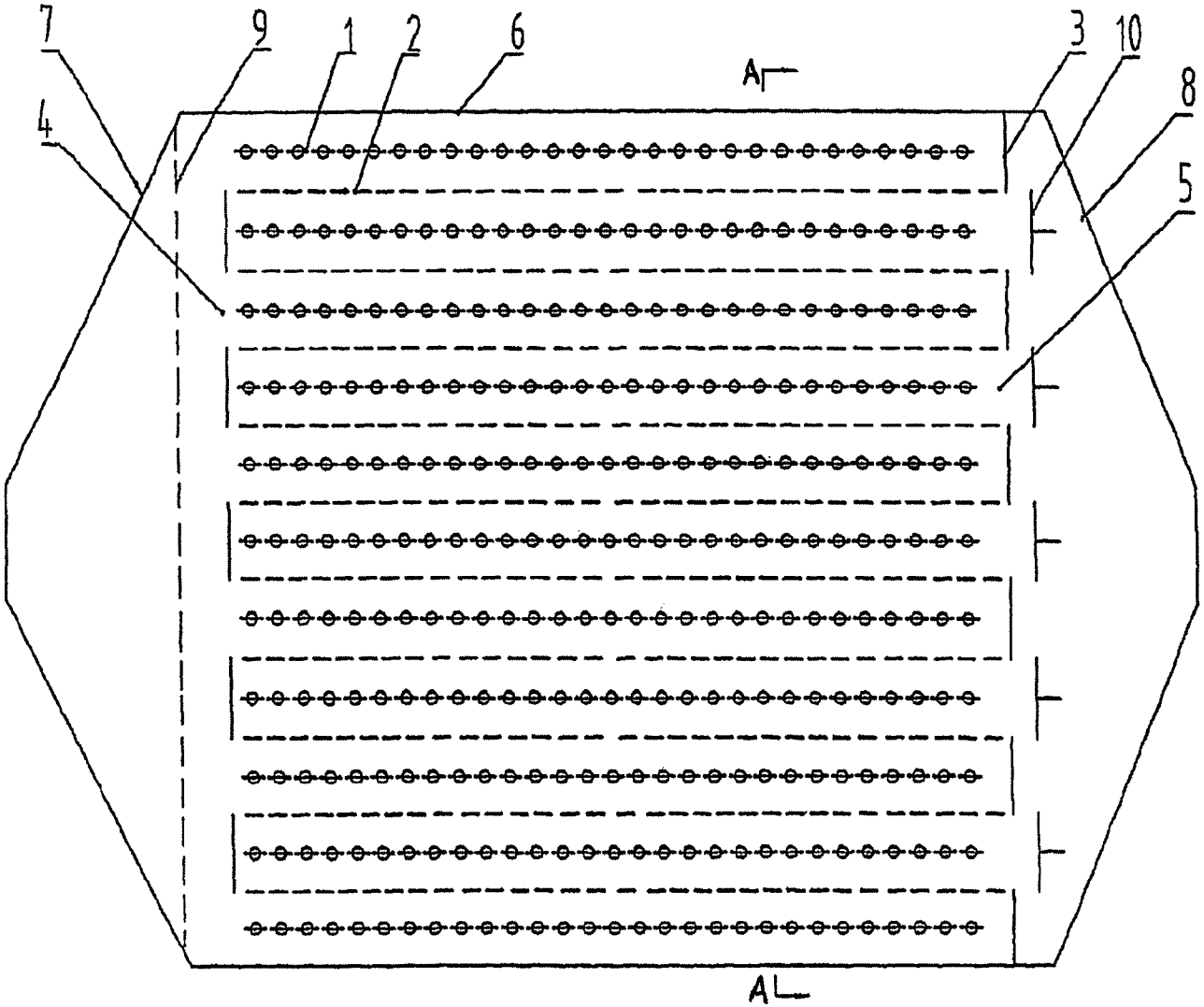
FIG. 2 is a transverse section view of the embodiment 1 of the electrostatic precipitator with high efficiency of the present invention.

As shown in FIG. 2, the electrostatic precipitator of the present invention comprises a casing 6. At both ends of the casing 6, an inlet chamber 7 and an outlet chamber 8 are mounted respectively. An air flow distribution board 9 for guiding the intake air flow is mounted on the inlet chamber 7. In the casing 6, corona discharge electrode lines 1 and dust-collecting electrode plates 2, which form a plurality of sedimentation passages, are arranged in parallel. Wind shields 3 are arranged alternately at both ends of each two adjacent sedimentation passages to form a plurality of air intake sedimentation passages 4 and air exhaust sedimentation passages 5. The air outlet of each air exhaust sedimentation passages 5 corresponds to a valve 10 which is mounted on the outlet chamber 8. The valve 10 will be described thereinafter.

Figure 3:
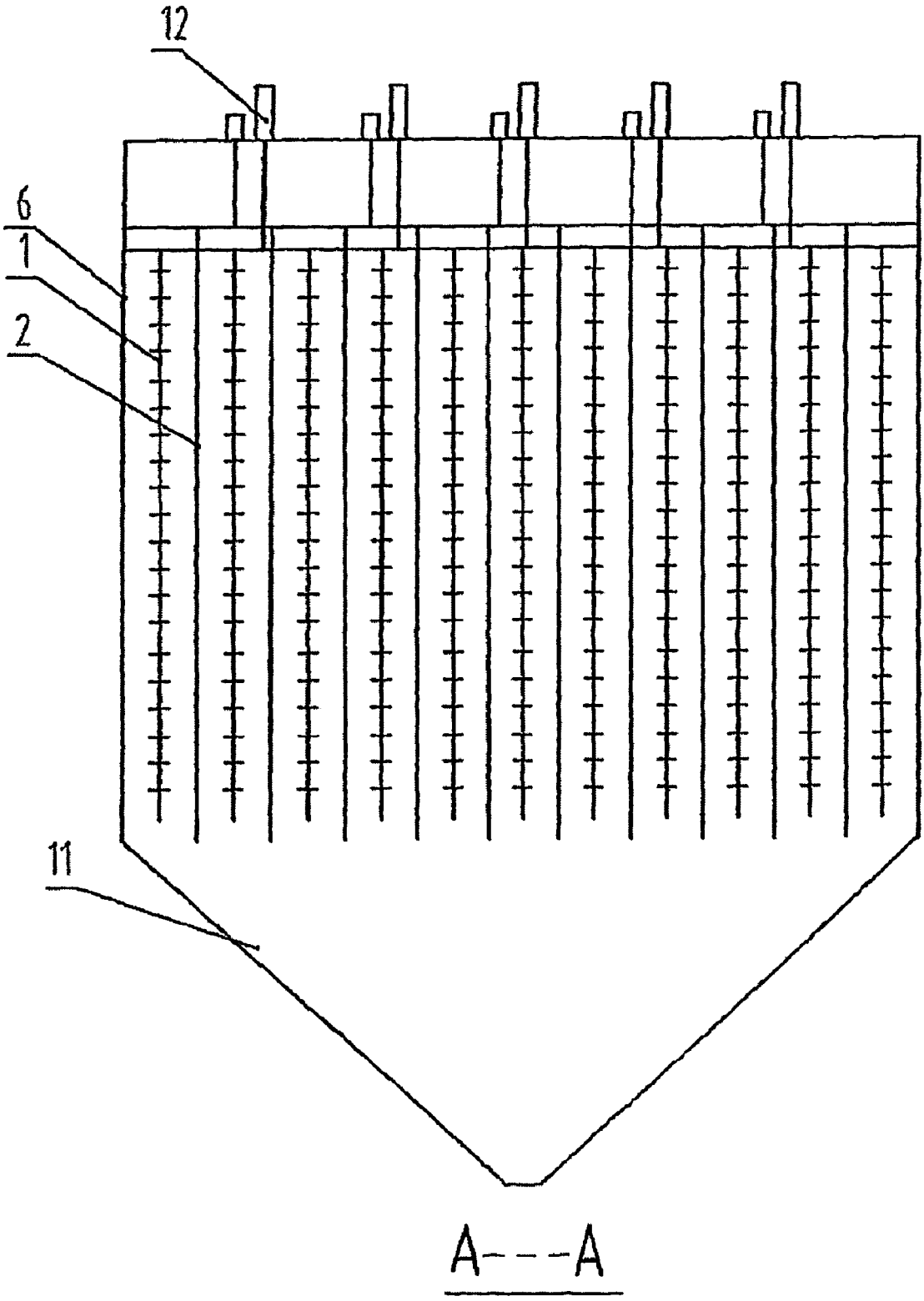
FIG. 3 is a cutaway view of the section A-A in FIG. 2.

As shown in FIG. 3, vibration apparatuses for cleaning dust 12 are placed respectively on the corona discharge electrode lines 1 and the dust-collecting electrode plates 2. A dust hopper 11 for receiving dust is arranged at the lower part of the casing 6.

Figure 6:
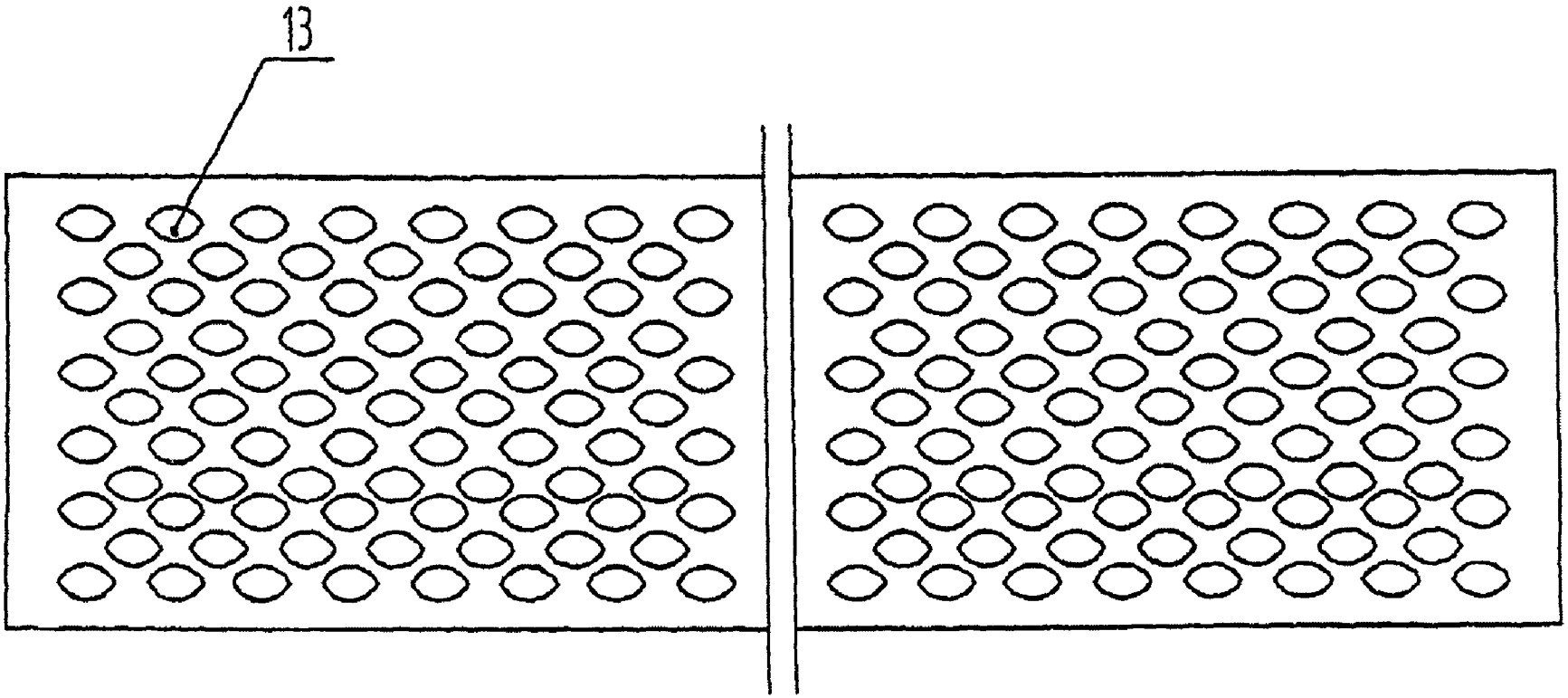
FIG. 6 is a structural schematic diagram of air vents 13 on the dust-collecting electrode plates 2 of the present invention.

A plurality of air vents 13 are distributed on the dust-collecting electrode plates 2. As shown in FIG. 6, the air vents 13 are arranged on a metal plate at an equal spacing. The air vents 13 in this embodiment are small elliptical holes with a long axis diameter of 50 mm and a short axis diameter of 30 mm distributed on the dust-collecting electrode plates 2 uniformly. The new type dust-collecting electrode plates 2 are used in both the embodiment 2 and the embodiment 3.

As shown in FIG. 2, the air outlet of each air exhaust sedimentation passages 5 corresponds to a valve 10 connected for closing the air outlet. The valve 10 is mounted on the outlet chamber 8. An automatic control system is available in the casing 6 to control closing and opening the valve 10 and meanwhile it controls starting and stopping the vibration apparatuses for cleaning dust 12, and it enables the closing and opening of the valve 10 to act synchronously together with the vibration apparatuses. The vibration process in each sedimentation passage is carried out in sequence.

The working process of the present invention is as follows: After the electrostatic precipitator with high efficiency of the present invention is electrified and ventilated, the dust-laden airflow goes into each air intake sedimentation passage 4 through the inlet chamber 7. The dust particles in the air flow are charged electrically when the corona discharge electrode lines 1 release a lot of negative electric ions. The dust particles charged electrically are absorbed by and deposited on the dust-collecting electrode plates 2 when they go through the air vents 13 on the dust-collecting electrode plates 2. The air, in which part of dust particles are removed, then flows into the air exhaust sedimentation passage 5. The remaining dust particles in the air flow are absorbed by the corona discharge electrode lines 1 and the dust-collecting electrode plates 2 in the air exhaust sedimentation passage 5. The cleaned air flow is eventually discharged from the outlet chamber 8 through opening the valve 10.

When the dust absorbed by the dust-collecting electrode plate 2 in one sedimentation passage 5 reaches a certain amount, the valve 10 for that sedimentation passage is closed by the automatic control system. At that time, there is no air flow in that sedimentation passage. Meanwhile, the automatic control system starts the vibration apparatuses for cleaning dust 12 respectively on the corona discharge electrode line 1 and the dust-collecting electrode plate 2 in that air exhaust sedimentation passage and its adjacent air intake sedimentation passage for cleaning dust. After the vibration for cleaning dust is done, the automatic control system will open that valve 10 and resume the normal dust removal of that air intake sedimentation passage. Then, the automatic control system will close the valve of the next air exhaust sedimentation passage for cleaning dust by vibration. The dust cleaning by vibration for each sedimentation passage is carried out in turn and this operation is repeated.

Embodiment 2

Figure 4:
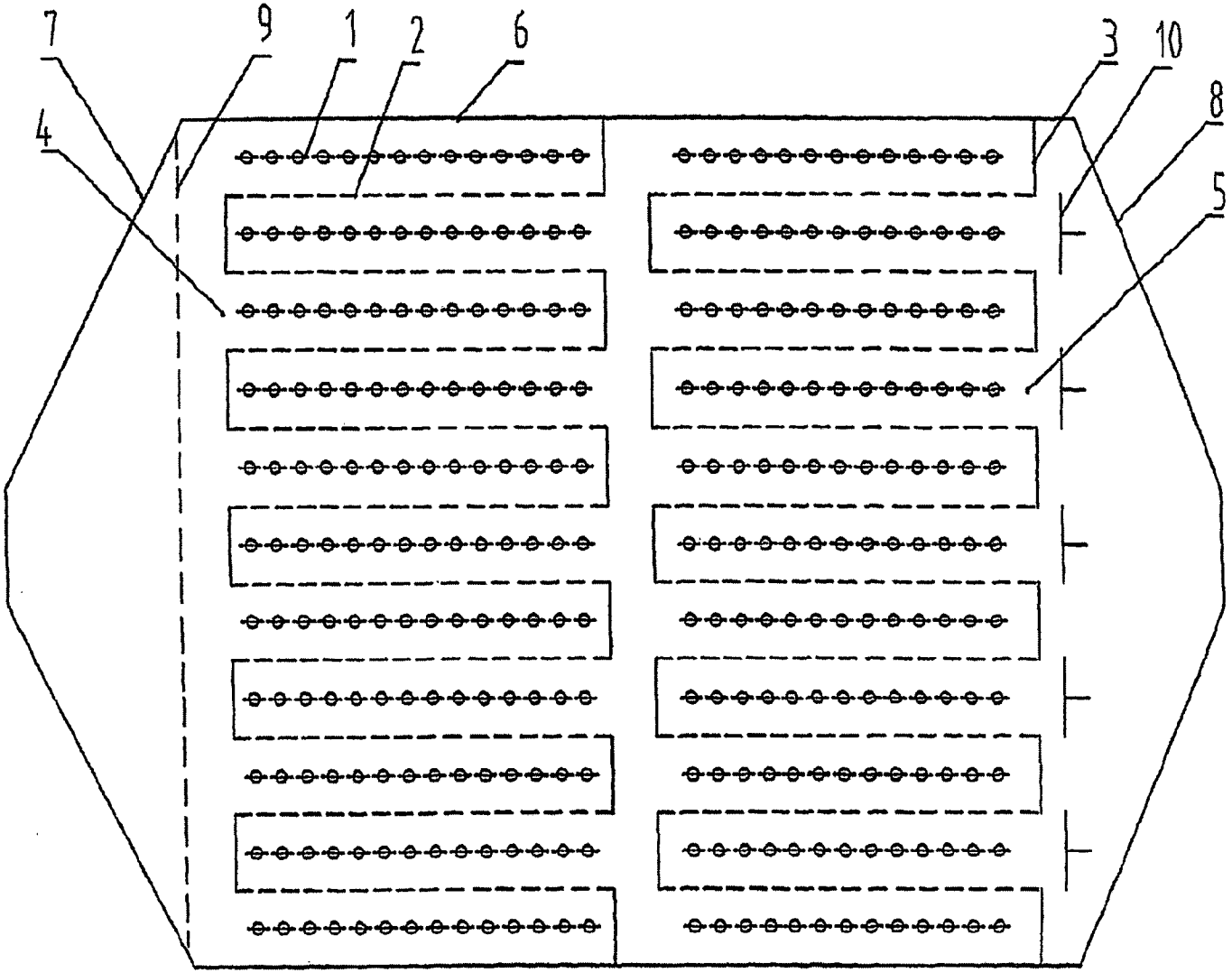
FIG. 4 is a transverse section view of the embodiment 2 of the present invention.

As shown in FIG. 4, the difference between this embodiment and the embodiment 1 is that there are two electric fields for dust removal arranged along the direction of a transverse section in the casing 6 of the present embodiment, i.e. the first electric field and the second electric field if a plurality of arrays of longitudinal and parallel sedimentation passages form an electric field for dust removal. In each electric field for dust removal, the corona discharge electrode lines 1, the dust-collecting electrode plates 2 and the wind shields 3 are arranged alternately to form a plurality of air intake sedimentation passages 4 and air exhaust sedimentation passages 5.

In this embodiment, the valve 10 is only located in the outlet chamber 8 at the air outlet of the second electric field. The vibration apparatuses for cleaning dust 12 in the first electric field are controlled by the automatic control system for cleaning dust by vibration at any time, while the vibration apparatuses for cleaning dust in the second electric field are controlled by the automatic control system for cleaning dust by vibration after the system closes the valve 10 at the end of each air exhaust sedimentation passages 5 in turn.

Other structures of this embodiment are the same as those in the embodiment 1 and they are not repeated herein.

Embodiment 3

Figure 5:
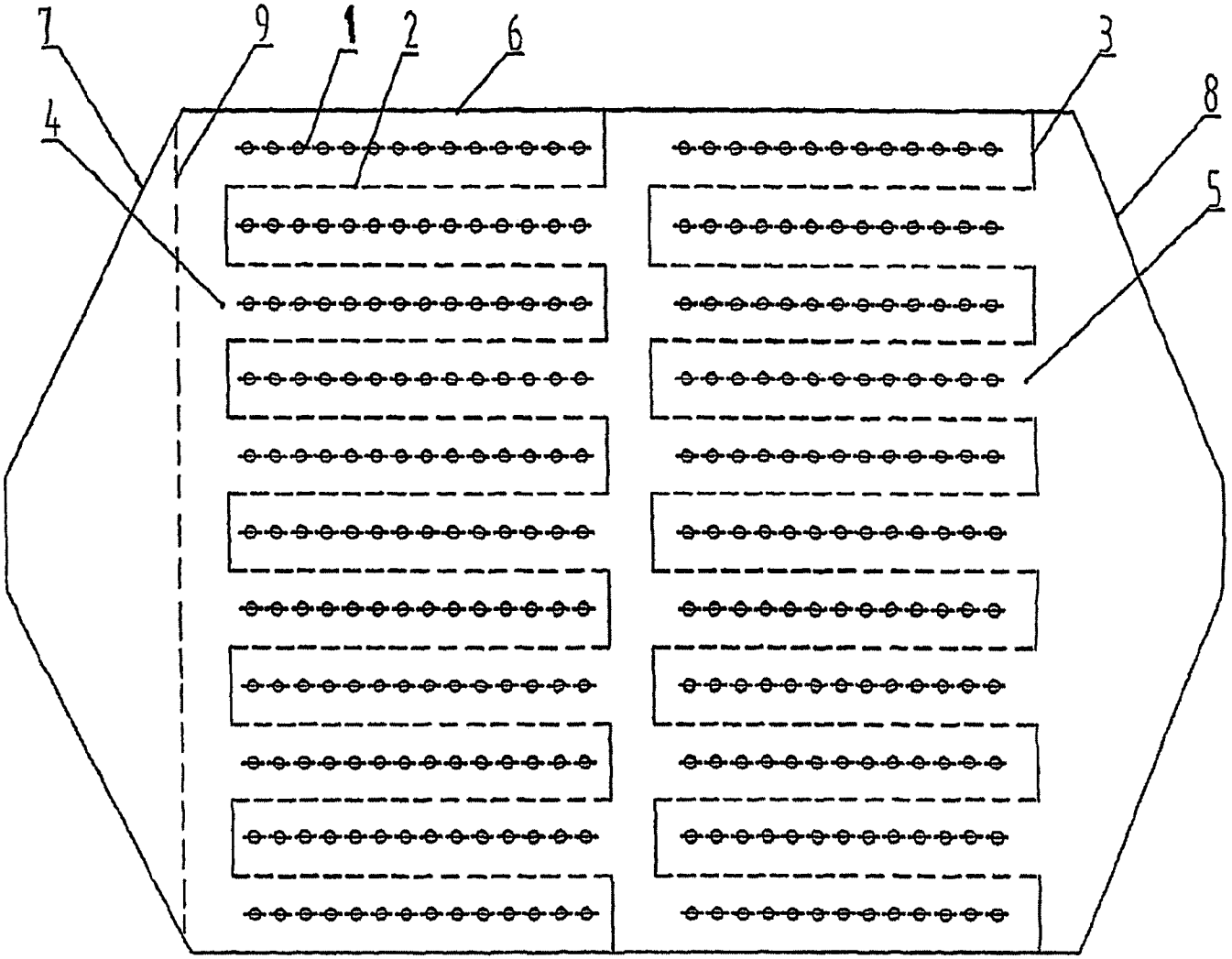
FIG. 5 is a transverse section view of the embodiment 3 of the present invention.

As shown in FIG. 5, the difference between this embodiment and the embodiment 2 is that there is no valve mounted at the air outlet of the second electric field and the process of cleaning dust by vibration is completed in a common way. This apparatus is mainly used in the applications which do not require a high level of the dust removal. This embodiment may apply to the technical upgrading of the electrostatic precipitators in the existing technology.

Embodiment 4

Figure 7:
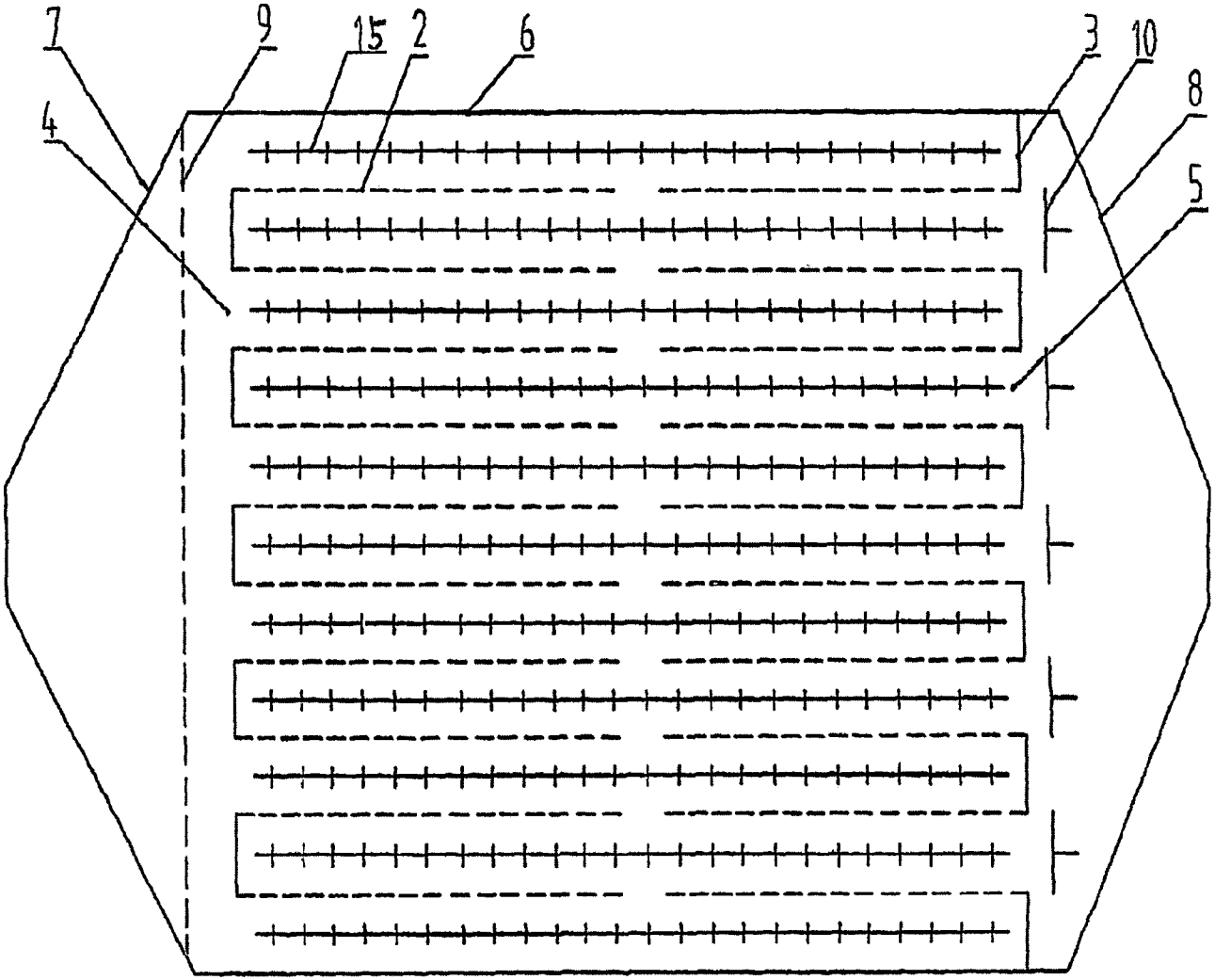
FIG. 7 is a transverse section view of the embodiment 4 of the present invention.

As shown in FIG. 7, in this embodiment, a Corona discharge electrode plate 15 and the dust-collecting electrode plates 2, which form a plurality of sedimentation passages, are arranged in the casing 6. The wind shields 3 are arranged alternately at both ends of each two adjacent sedimentation passages to form a plurality of air intake sedimentation passages 4 and air exhaust sedimentation passages 5 which are arranged alternately. The air outlet of each air exhaust sedimentation passages 5 corresponds to the valve 10 which is mounted in the outlet chamber 8.

Figure 8:
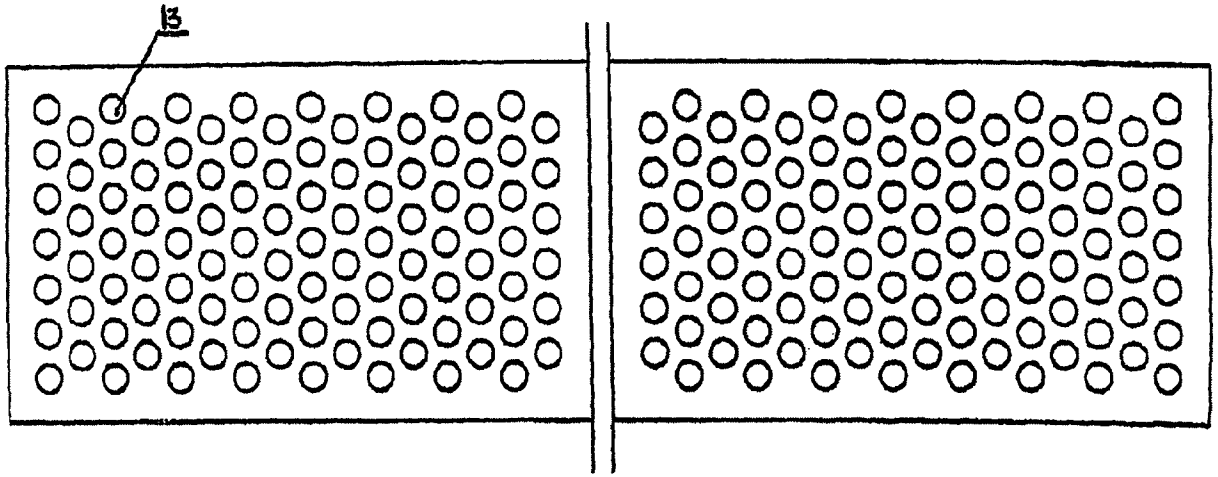
FIG. 8 is a structural schematic diagram of air vents 13 on the dust-collecting electrode plates 2 of the embodiment 4 of the present invention.

As shown in FIG. 8, on the basis of the dust-collecting electrode plates in FIG. 6, the same air vents with an aperture of 40 mm are arranged on a metal plate at an equal spacing. And the center of each air vent is corresponding to a discharge electrode tip 14 mounted on the Corona discharge electrode plate 15 as shown in FIG. 9.

Figure 9:
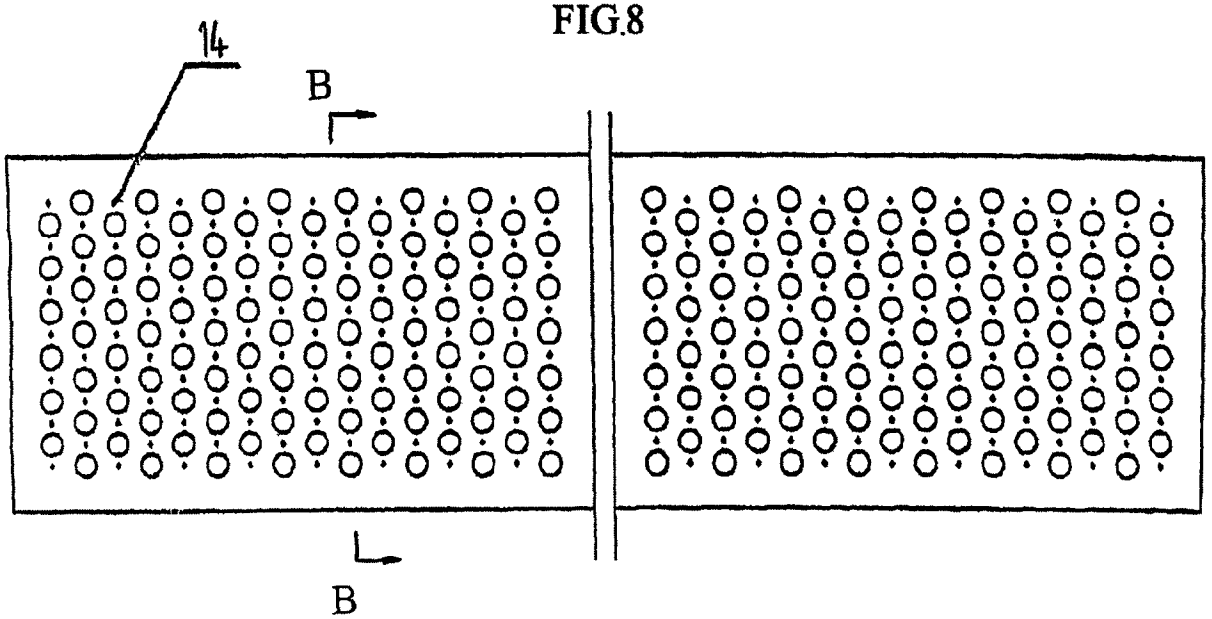
FIG. 9 is a structural schematic diagram of the corona discharge electrode plate 15 of the embodiment 4 of the present invention.

The Corona discharge electrode plate 15 in this embodiment as shown in FIG. 9 is a new type. The discharge electrode tips 14 with same length are arranged at an equal spacing on a metal plate, on which there are some small holes. The metal plate corresponds to the corona discharge electrode lines. The discharge electrode tips 14 and the metal plate constitute the Corona discharge electrode plate 15. The small holes on the Corona discharge electrode plate 15 and the discharge electrode tips 14 on the corona discharge electrode lines are arranged alternately to each other.

Figure 10:
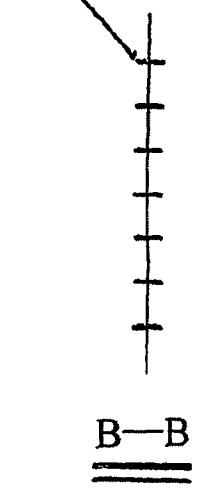
FIG. 10 is a cutaway view of the section B-B in FIG. 9.

FIG. 10 is a cutaway view of the section B-B in FIG. 9. The discharge electrode tips 14 with same length are arranged at an equal spacing on a metal plate, on which there are some small holes.

The invention claimed is:

1. An electrostatic precipitator with high efficiency comprises a casing, an inlet chamber and an outlet chamber being mounted respectively at both ends of the casing, a dust hopper being arranged at the lower part of the casing, wherein the corona discharge electrode lines and the dust-collecting electrode plates, which form a plurality of sedimentation passages, are arranged in the casing in parallel and alternately, vibration apparatuses for cleaning dust being placed respectively on the corona discharge electrode lines and the dust-collecting electrode plates, wherein the corona discharge electrode lines are connected to the negative terminal of high voltage DC output, while the dust-collecting electrode plates are connected to the positive terminal of high voltage DC output and to earth, wherein the plurality of sedimentation passages arranged in parallel and alternately in the casing are built by the corona discharge electrode lines and the dust-collecting electrode plates with a plurality of air vents, wind shields are arranged alternately at both ends of each two adjacent sedimentation passages to form a plurality of air intake sedimentation passages and air exhaust sedimentation passages which are arranged alternately, and the passages, where the wind shields are located on the side of an air outlet, are the air intake sedimentation passages, and the air exhaust sedimentation passages with the wind shields located on the side of an air inlet.

2. The electrostatic precipitator with high efficiency as claimed in claim 1, wherein said air vents are the holes uniformly distributed on the dust-collecting electrode plates.

3. The electrostatic precipitator with high efficiency as claimed in claim 2, wherein said air vents are long rectangular holes with a width of 20-50 mm and a length of 100-800 mm, or are small elliptical holes with a long axis diameter of 20-50 mm and a short axis diameter of 20-30 mm.

4. The electrostatic precipitator with high efficiency as claimed in any one of claims 1 to 3, wherein a valve is mounted on the side of the air outlet of each air exhaust sedimentation passage for closing the air outlet, and an automatic control system is available to enable the closing and opening of the valve to act synchronously together with the vibration of the vibration apparatuses for cleaning dust in that sedimentation passage.

5. The electrostatic precipitator with high efficiency as claimed in any one of claims 1 to 3, wherein the plurality of arrays of longitudinal and parallel sedimentation passages in the casing form an electric field for dust removal, and there are two or more than two electric fields for dust removal arranged along the direction of transverse section in the casing.

6. The electrostatic precipitator with high efficiency as claimed in claim 5, wherein when two or more than two electric fields for dust removal are arranged in the casing, a valve is mounted on the side of the air outlet of the air exhaust sedimentation passage of the last electric field for closing the air outlet, an automatic control system is available to control the shutting and opening of the valve and the vibration of the vibration apparatuses for cleaning dust in that sedimentation passage to act synchronously.

* * * * *

UNITED STATES PATENT AND TRADEMARK OFFICE

CERTIFICATE OF CORRECTION

PATENT NO. : 7,901,489 B2
APPLICATION NO. : 11/990180
DATED : March 8, 2011
INVENTOR(S) : Lieshui Jin et al.

It is certified that error appears in the above-identified patent and that said Letters Patent is hereby corrected as shown below:

In section (73), the Assignee presently reads, Environmental Research Institute, but should read Lieshui JIN, ZheJiang Province, China.

Signed and Sealed this
Twentieth Day of December, 2011

David J. Kappos

David J. Kappos
*Director of the United States Patent and Trademark Office*